US005379853A

United States Patent [19]

Lockwood et al.

[11] Patent Number: 5,379,853

[45] Date of Patent: Jan. 10, 1995

[54] DIAMOND DRAG BIT CUTTING ELEMENTS

[75] Inventors: Michael C. Lockwood, Heber City; Richard H. Dixon, Provo; Christopher A. Reed, Spanish Fork; Ronald B. Crockett, Provo, all of Utah; Kenneth W. Jones, Kingwood, Tex.

[73] Assignee: Smith International, Inc., Houston, Tex.

[21] Appl. No.: 124,892

[22] Filed: Sep. 20, 1993

[51] Int. Cl.[6] ..... E21B 10/46

[52] U.S. Cl. ..... 175/428; 175/434; 51/307; 76/108.4

[58] Field of Search ..... 175/434, 425, 428; 51/293, 309, 308, 307; 76/108.2, 108.4

[56] References Cited

U.S. PATENT DOCUMENTS

| | | | |
|---|---|---|---|
| 4,171,339 | 10/1979 | Lee et al. | 51/309 X |
| 4,592,433 | 6/1986 | Dennis | 175/428 |
| 4,604,106 | 8/1986 | Hall et al. | 175/434 X |
| 4,694,918 | 9/1987 | Hall | 175/414 X |
| 4,753,305 | 6/1988 | Fisher | 175/428 |
| 4,776,411 | 10/1988 | Jones | 175/393 |
| 4,784,023 | 11/1988 | Dennis | 175/434 X |
| 4,807,402 | 2/1989 | Rai | 51/293 |
| 4,976,324 | 12/1990 | Tibbitts | 175/428 |

*Primary Examiner*—Stephen J. Novosad
*Attorney, Agent, or Firm*—Robert G. Upton

[57] ABSTRACT

A unitized polycrystalline composite diamond stud type drag bit cutter having no high temperature braze of a PDC wafer to a carbide stud is disclosed. The diamond cutting surface may be planar, convex, curved or a truncated cone. The unitized construction of the cutter eliminates the problems associated with the high temperature brazing of a PDC wafer to a carbide stud.

9 Claims, 2 Drawing Sheets

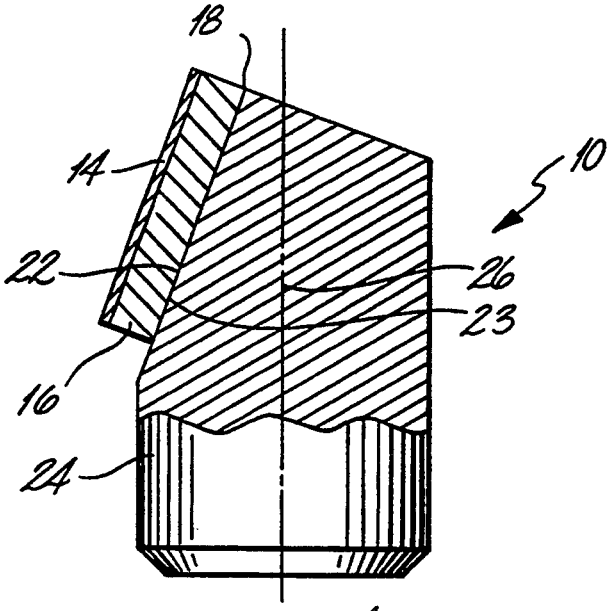
Fig. 1
PRIOR ART
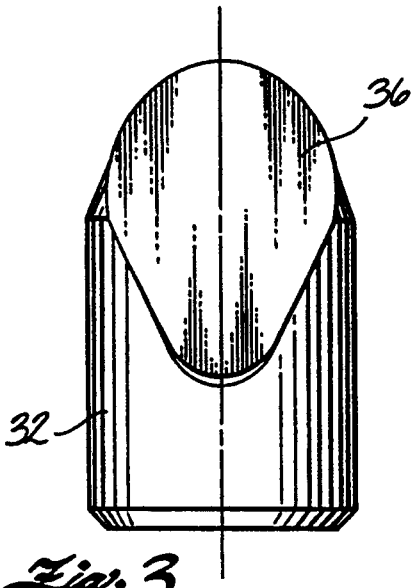
Fig. 3
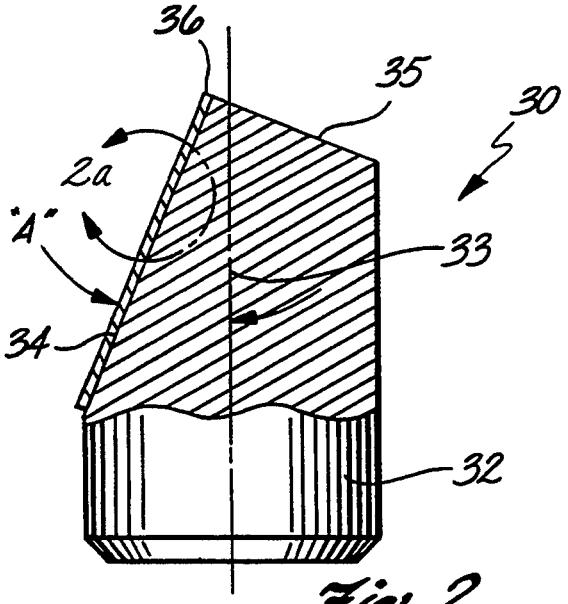
Fig. 2
Fig. 2a
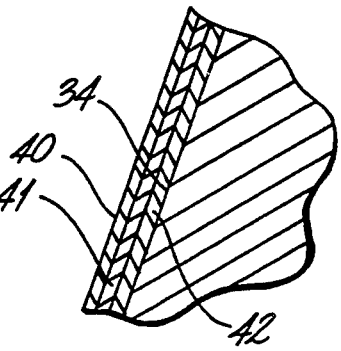

Fig. 6
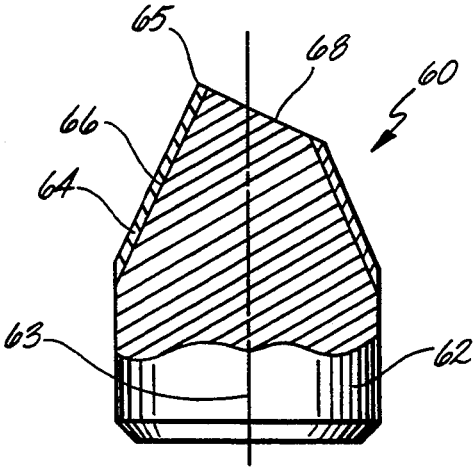
Fig. 4
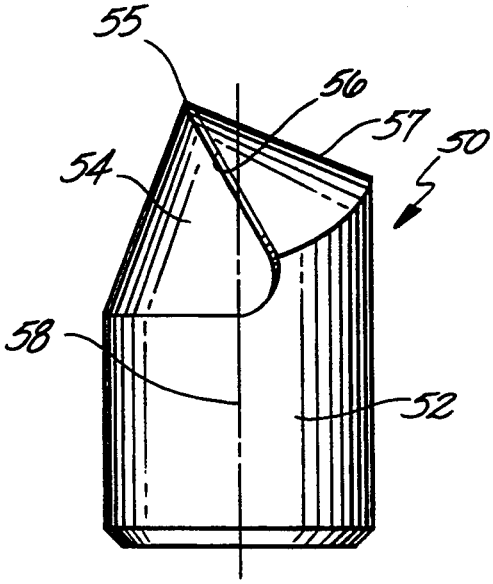
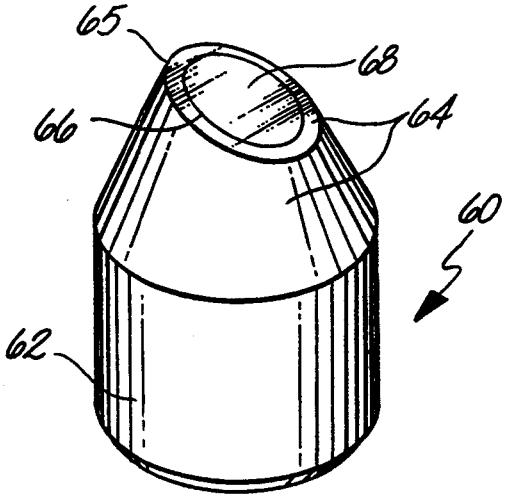
Fig. 7
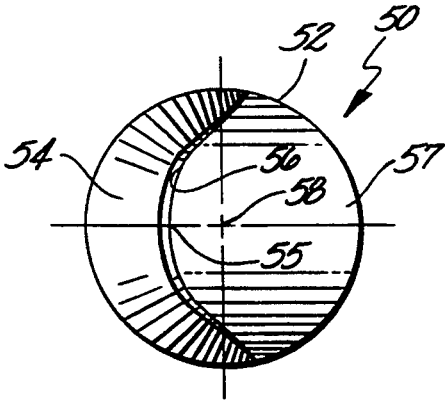
Fig. 5

DIAMOND DRAG BIT CUTTING ELEMENTS

CROSS-REFERENCE TO ELATED APPLICATION

This application is related to a previously filed patent application entitled Polycrystalline Diamond Compact, filed Mar. 3, 1993 as U.S. Ser. No. 026,890.

BACKGROUND OF THE INVENTION

I. Field of the Invention

The present invention relates to diamond drag bits.

More particularly, this invention relates to diamond cutting elements for diamond drag bits.

II. Description of the Prior Art

Polycrystalline diamond compacts (PDC) have been effectively used for cutters on drag bits while drilling soft earthen formations in petroleum and mining exploration for more than a decade.

The most common cutter type used in PDC drag bits is classified in the drilling industry as a "stud" type PDC.

For example, a typical stud type PDC cutter is illustrated in FIG. 6 and FIG. 7 of U.S. Pat. No. 4,776,411 assigned to the same assignee as the present invention and hereby incorporated by reference.

Practically all stud-type PDC cutters used, to date, have been manufactured as two piece units. A thin layer (approximately 0.030" to 0.040") of polycrystalline diamond is chemically/metallurgically bonded to a face of a much thicker (approximately 0.150" to 0.190") right cylinder wafer of cobalt cemented tungsten carbide. This integral diamond/carbide compact is then brazed to a cobalt cemented tungsten carbide modified cylindrical stud or post at an angle of between 15° to 20° from the vertical axis of the stud. The top surface of the stud is typically radiused to conform to the diamond/-carbide wafer cylindrical surface and relieved rearwardly normal to the diamond surface.

Although PDC stud type cutters, as currently manufactured, serve a very useful purpose, there are many disadvantages in their manufacture and application.

The flat on the stud to which the PDC wafer is brazed and the carbide side of the PDC wafer must have extremely fine ground surfaces to affect a braze of necessary strength. These grinding operations are time consuming and costly.

The bonding of the PDC wafer to the carbide stud is fraught with many variables that are difficult to control. The braze temperature is significantly higher than the thermal degradation temperature of the diamond table and the bond interface of the diamond and carbide. Therefore, the diamond has to be protected by a complicated heat sink apparatus that is difficult to control during the braze cycle. A high reject ratio is inherent in this process lowering output and driving up costs. The actual braze quality is difficult to determine even with the most sophisticated non-destructive testing equipment available. An undesirable level of less than good brazes go undetected and wind up as PDC cutter failures in the field. The brazing process can also cause incipient and premature failure of the bond of the diamond layer to the carbide wafer which also will show up as a PDC cutter failure in the field. It is also difficult to braze a PDC cutter wafter that has two or more carbide particle/diamond particle transition layers that have a high cobalt level because the high differential in thermal expansion causes the PDC layer to crack during the braze cycle.

A new stud type PDC cutter is disclosed that eliminates the need to braze a PDC wafer to a tungsten carbide stud, thereby obviating the problems and inadequacies described above in current PDC stud design and processes.

SUMMARY OF THE INVENTION

It is an object of the present invention to provide a stud type PDC cutter that does not require a braze of a PDC wafer to a tungsten carbide stud.

More specifically, it is an object of the present invention to provide a stud type PDC cutter that has a thin polycrystalline diamond layer directly bonded to a preformed planar or non-planar surface on a tungsten carbide stud using the high pressure/high temperature diamond tape cast process described in U.S. patent application Ser. No. 026,890.

The present invention is directed to a method of producing a polycrystalline diamond composite stud type cutter that requires no braze, preferably using the techniques and processes commonly referred to as "tape casting" in conjunction with high pressure/high temperature (HP/HT) diamond synthesis technology. Tape casting technology is commonly used in the electronics industry to fabricate ceramic coatings, substrates and multilayer structures. Tapes of various materials can be produced by Doctor Blade Casting Process or by High Shear Compaction Process, a proprietary process by Ragan Technologies, a division of Wallace Technical Ceramics, Inc., 11696 Sorrento Valley Road, Suite D, San Diego, Calif. 92121. The two tape process has been successfully used to produce products. Some of the basic advantages of High Shear Compaction Process over Doctor Blade Process are as follows: (1) non-uniform density; (2) higher green density; (3) process flexibility in controlling thickness, surface finish; and (4) higher reliability and flexibility. Diamond layers and composites can also be beneficially made by tape casting methods. Fine diamond powder is mixed with a temporary binder. The binder can be natural or synthetic high molecular weight substances such as starches, alcohols, celluloses and polymers. The diamond powder/binder mixture is milled to a homogeneous mass then rolled into strips (tapes) of the desired thickness and width, then dried to remove volatile carriers. The green tape is strong and flexible enough to be handled. The tape may be cut into the necessary shapes to conform to a tungsten carbide substrate geometry where it is temporarily glued. This assembly is then placed in a refractory metal HT/HP reaction mold and heated in a vacuum to drive off the temporary binder. The mold assembly is now placed in a HT/HP diamond synthesis apparatus to sinter the diamond grains together and bond the diamond mass to the carbide substrate.

The present invention consists of a diamond insert stud cutter for a rock bit. Each cylindrical stud cutter is preferably formed from tungsten carbide. The body forming a first cylindrical base end, and a second cutter end having at least one diamond layer directly bonded to a pre-formed surface formed by the second cutter end. The diamond layer is formed by a high pressure, high temperature sintering process. The pre-formed surface may be angled negatively with respect to an axis of the stud body 5° to 30° with a preferred angle of 20°.

It should be understood that cubic boron nitride particles, or other ultra hard material particles, may be used in lieu of diamond particles in the fabrication of tape castings in the above described process to manufacture a brazeless stud type cutter.

For certain applications or cutter geometries, it may be advantageous to use other means than tape cast processes to bond an ultra hard material mass to a carbide substrate surface to form a brazeless cutter. For example, a method may be injection molding of diamond, cubic boron nitride or other ultra hard particles admixed with a binder into a mold cavity containing a pre-formed carbide substrate. This assembly would then be sintered under high pressure/high temperature conditions to form a brazeless cutter.

Another method may be extrusion of a hard particle/-binder mass into a pre-form for subsequent high pressure/high temperature sintering to a carbide substrate.

Another method may be the placing of loose ultra hard particles into a mold cavity containing a pre-formed carbide substrate for subsequent high pressure/-high temperature sintering to the carbide substrate.

Diamond tape cast methods are described in previously filed patent application entitled Polycrystalline Diamond Compact, filed Mar. 3, 1993 as U.S. Ser. No. 026,890 heretofore noted.

Diamond tape cast variations have been furnished to the present inventor for high pressure/high temperature evaluation by Ragan Technologies, Division of Wallace Technical Ceramics, Inc., 11696 Sorrento Valley Road, Suite D, San Diego, Calif. 92121.

An advantage then, of the present invention over the prior art, is the direct bonding of a thin polycrystalline diamond layer to a pre-formed surface of a carbide stud. The foregoing process eliminates the need to braze a PDC wafer to a tungsten carbide stud thereby eliminating a potential low strength braze, high residual stresses at the PDC wafer/carbide stud interface and thermal damage to the diamond layer due to the brazing process.

Another advantage of the present invention over the prior art is direct bonding of a diamond layer to a planar or non-planar surface of a carbide stud which allows more flexibility in cutter design, such as curved cutter surfaces for more efficient cutting action and greater strength.

Still another advantage of the present invention is that it provides a more rigid carbide backing for greater strength as the carbide stud is continuous with no braze interruption.

Yet another advantage of the present invention over the prior art is multiple transition layers of varying percentages of diamond and tungsten carbide particles may be directly bonded to a carbide stud surface to provide superior impact strength of the diamond table and the bond line.

The above-noted objects and advantages of the present invention will be more fully understood upon a study of the following description in conjunction with the detailed drawings.

BRIEF DESCRIPTION OF THE DRAWINGS

FIG. 1 is a partial cross-section of a prior art cylindrical stud type polycrystalline diamond compact drag bit cutter, FIG. 2 and exploded view FIG. 2*a* are partial cross-section of an embodiment of the present invention illustrating an ultra hard planar composite layer of polycrystalline diamond directly bonded to a flat surface formed on a cylindrical tungsten carbide stud.

FIG. 3 is a frontal view of FIG. 2 showing an essentially circular polycrystalline diamond layer bonded to a flat surface formed on a cylindrical carbide stud.

FIG. 4 is a side view of an embodiment of the present invention which is an oblique or skewed cylinder having a thin composite layer of polycrystalline diamond bonded to a curved frontal surface formed on the tungsten carbide stud.

FIG. 5 is a top view of FIG. 4 showing a curved polycrystalline diamond layer bonded to a curved frontal surface of an essentially cylindrical tungsten carbide stud.

FIG. 6 is a partial cross-section of an embodiment of the present invention showing a cylindrical tungsten carbide stud having a truncated conical cutting end with a composite polycrystalline diamond layer bonded to the conical surface.

FIG. 7 is an isometric view of FIG. 6 showing a diamond layer bonded to the truncated conical surface of the tungsten carbide stud.

DESCRIPTION OF THE PREFERRED EMBODIMENTS AND BEST MODE FOR CARRYING OUT THE INVENTION

With reference to the prior art FIG. 1, a partial cross section of an insert cutter, generally designated as 10, illustrates a polycrystalline diamond stud type cutter for drag type drill bits. A thin cutting composite layer of polycrystalline diamond 14 is chemically and metallurgically bonded to a cylindrical tungsten carbide substrate 16 under high pressure/high temperature diamond synthesis conditions. Subsequently, the rearward side 23 of substrate 16 is ground to a flat polished surface and is then attached by a high temperature braze 18 to ground flat surface 22 on carbide stud 24 which is formed at a rearward angle from 15° to 20° relative to axis 26 of carbide stud 24. The preferred rearward angle is 20°.

FIG. 2 is a partial cross section of a diamond drag bit cutter and is an embodiment of the present invention which is generally designated as 30. A cylindrical tungsten carbide stud 32 has a pre-formed flat 34 that is rearwardly inclined 5° to 30° from a stud axis 33 (angle A). The top surface 35 of stud 32 forms, for example, a radius which becomes tangent to the side edges of flat 34. A thin planar composite diamond cutting layer 36 is formed on flat 34 of stud 32 using high pressure/high temperature diamond synthesis conditions. This creates diamond to diamond bonding and bonding of diamond composite layer 36 to carbide stud flat 34. As shown in exploded view 2*a* of FIG. 2, it is generally desirable to form, by diamond tape cast methods, composite diamond layer 36 as a gradient of diamond and pre-cemented tungsten carbide particles. For example, 90–100% diamond particles would compromise outer layer 40 then reduce to approximately 50%—50% diamond and carbide particles in middle layer 41. Inner layer 42 is compromised of 90–100% carbide particles. This produces a composite diamond layer 36 with very low residual stresses coupled with a very hard and wear resistant outer surface 40 as an integral part of cutter 30 having no braze.

FIG. 3 is a front view of FIG. 2 and shows the essentially circular planar composite diamond layer 36 chemically and metallurgically bonded to pre-formed but not necessary precision ground flat 34 of stud 32.

FIG. 4, another embodiment of the present invention, generally designated as 50, is an oblique or skewed cemented carbide cylinder 52. A pre-formed formed curved frontal surface 56, which slopes rearwardly 5°-30° in reference to stud axis 58, has a relatively thin (0.010"-0.050 ") non-planar polycrystalline diamond layer 54 bonded thereto under high pressure/high temperature diamond synthesis conditions. The composite diamond layer 54 is preferably fabricated by using diamond tape cast methods. This produces a cutter 50 having very low residual stresses and an ultra hard and wear resistant cutting surface 54 without the use of an undesirable braze.

FIG. 5 is a top view of FIG. 4 showing a curved polycrystalline diamond surface 54 bonded to a pre-formed curved oblique surface 56 of tungsten carbide stud 52 The diamond layer 54 is inclined rearwardly in relation to stud axis 58 terminating at apex 55. Top surface 57 of carbide stud body 52 is formed essentially perpendicular to curved surface 56 and intersects the edges of diamond layer 54. This forms heel clearance for diamond cutting layer 54 while the cutter works in a borehole.

FIG. 6, another embodiment of the present invention, is a drag bit cutter 60 having a cylindrical tungsten carbide body 62 and a truncated conical cutting end surface 64. Cylindrical cutter body 62 forms a truncated conical surface 66 to which a thin layer of polycrystalline diamond 64 has been chemically and metallurgically bonded using high pressure/high temperature diamond synthesis techniques. This forms an integral unit with carbide body 62. The angled surface 68 is formed by directing an EDM cut into the conical surface layer 64 about 90° to the surface. This creates the desired leading cutting edge 65 and the top trailing edge surface 68. The angled surface 68 being at an oblique angle to an axis 63 giving cutting edge 65 heel clearance while drilling. Cutter 60, so formed, has very low residual stresses and requires no potentially deleterious braze. While the diamond layer 64 on the trailing conical surface of cutter 60 plays no part in the drilling action, bonding of a composite diamond layer 64 to the entire conical surface 66 before the truncation procedure simplifies the manufacturing process. It also produces superior diamond layer properties (64).

FIG. 7 is a perspective view of FIG. 6. It illustrates the diamond layer 64 bonded to the carbide substrate 66. Also it shows the cutting edge 65 formed by the EDM cut.

It should be noted that a single layer or multiple layers of diamond may be utilized in fabricating the above described embodiments to meet the needs for field application or for ease of manufacture.

It should also be understood that other ultra hard materials, such as cubic boron nitride particles, may be used in lieu of diamond particles to form the ultra hard cutting layers of all the above embodiments.

It will, of course, also be realized that various modifications can be made in the design and operation of the present invention without departing from the spirit thereof. Thus, while the principle preferred construction and mode of operation of the invention have been explained in what is now considered its best embodiments, which have been illustrated and described, it should be understood that within the scope of the appended claims, the invention may be practiced otherwise than as specifically illustrated and described.

What is claimed is:

1. An insert stud cutter comprising;

a tungsten carbide cylindrical body, said body forming a first cylindrical base end, said second cutter end having at least one ultra hard layer directly bonded to a pre-formed surface by said second cutter end, said ultra hard layer may comprise one or more layers of tape cast material.

2. The invention as set forth in claim wherein hard layer may comprise injection molded material.

3. The invention as set forth in claim 1 wherein said ultra hard layer may comprise extruded material.

4. A diamond insert stud cutter for a rock bit comprising;

a tungsten carbide cylindrical body, said body forming a first cylindrical base end, and a second cutter end, said second cutter end having at least one diamond layer directly bonded to a pre-formed surface formed by said second cutter end by a high pressure, high temperature sintering process, said pre-formed surface is a truncated cone.

5. The invention as set forth in claim 4 wherein said diamond may comprise one or more layers of diamond tape cast material sintered to said pre-formed surface.

6. The invention as set forth in claim 4 wherein said diamond may comprise injection molded diamond material sintered to said pre-formed surface.

7. The invention as set forth in claim 4 wherein said diamond may comprise extruded diamond material sintered to said pre-formed surface.

8. An insert stud cutter for rock bits comprising;

a tungsten carbide cylindrical body, said body forming a first cylindrical base end, and a second cutter end, said second cutter end having at least one layer of Cubic Boron Nitride directly bonded to a pre-formed surface formed by said second cutter end by a high pressure, high temperature sintering process, said pre-formed surface is a truncated cone.

9. The invention a set forth in claim 8 wherein said Cubic Boron Nitride may comprise one or more layers of Cubic Boron Nitride tape cast material sintered to said pre-formed surface.

* * * * *